US008196901B2

(12) United States Patent
Halfmann et al.

(10) Patent No.: US 8,196,901 B2
(45) Date of Patent: Jun. 12, 2012

(54) SYSTEM AND METHOD FOR CONVERTING AN ENGINE TO AN ALTERNATE FUEL

(75) Inventors: Aaron Halfmann, Germantown, WI (US); James J. Dehn, Brookfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 722 days.

(21) Appl. No.: 12/351,326

(22) Filed: Jan. 9, 2009

(65) Prior Publication Data

US 2010/0176518 A1 Jul. 15, 2010

(51) Int. Cl.
*F02M 13/06* (2006.01)

(52) U.S. Cl. ..... 261/18.3; 261/DIG. 8; 261/DIG. 67

(58) Field of Classification Search ..... 261/18.1, 261/18.3, 35, DIG. 8, DIG. 67; 123/527
See application file for complete search history.

(56) References Cited

U.S. PATENT DOCUMENTS

| | | | | |
|---|---|---|---|---|
| 871,134 | A | 11/1907 | Monnier et al. | |
| 1,183,221 | A * | 5/1916 | Miller et al. | 261/18.3 |
| 1,383,994 | A | 7/1921 | Olson | |
| 1,808,587 | A | 6/1931 | Adams | |
| 1,885,331 | A | 11/1932 | Collins | |
| 2,323,639 | A * | 7/1943 | Anderson | 123/543 |
| 2,725,865 | A | 12/1955 | McDuffie | |
| 2,737,170 | A | 3/1956 | McDuffie | |
| 3,089,685 | A | 5/1963 | Hennemann et al. | |
| 3,948,226 | A | 4/1976 | Green et al. | |
| 3,970,059 | A | 7/1976 | Pisar | |
| 4,158,280 | A | 6/1979 | Thomas et al. | |
| 4,216,744 | A | 8/1980 | Oswald et al. | |
| 4,235,828 | A | 11/1980 | Howes | |
| 4,327,553 | A | 5/1982 | Rilett | |
| 4,351,300 | A | 9/1982 | Selvidge et al. | |
| 4,386,594 | A | 6/1983 | Szloboda | |
| 4,398,521 | A | 8/1983 | Schuurman | |
| 4,401,094 | A * | 8/1983 | Shimmura et al. | 123/576 |
| 4,413,474 | A | 11/1983 | Moscrip | |
| 4,415,507 | A | 11/1983 | Voliva | |
| 4,430,275 | A | 2/1984 | Horton | |
| 4,440,697 | A * | 4/1984 | Sakurai | 261/34.2 |
| 4,461,731 | A * | 7/1984 | Herd et al. | 261/18.3 |

(Continued)

FOREIGN PATENT DOCUMENTS

EP 1383994 8/2007

(Continued)

OTHER PUBLICATIONS

Beam LP-Gas Products Carburetion Product Catalogue, Available at least as early as Nov. 1988, 146 pages.

(Continued)

*Primary Examiner* — Richard L Chiesa
(74) *Attorney, Agent, or Firm* — Michael Best & Friedrich LLP

(57) ABSTRACT

An engine conversion kit for converting an engine that combusts gasoline to an engine that combusts a fuel other than gasoline, such as E85 which is 85 percent ethanol and 15 percent gasoline includes a carburetor having a vent passageway that defines a vent size, and an automatic choke system. The kit includes a second carburetor including a primer passageway and a second vent passageway having a second vent size that is smaller than the vent size. The second carburetor is adapted to attach to the engine and replace the carburetor. A primer bulb is configured to connect to the engine and is operable to force air into the primer passageway.

6 Claims, 15 Drawing Sheets

U.S. PATENT DOCUMENTS

| | | | | | |
|---|---|---|---|---|---|
| 4,492,208 | A | | 1/1985 | Lent | |
| 4,518,540 | A | * | 5/1985 | Takayasu | 261/18.3 |
| 4,528,966 | A | | 7/1985 | Lent et al. | |
| 4,535,728 | A | | 8/1985 | Batchelor | |
| 4,553,519 | A | | 11/1985 | Masson | |
| 4,570,587 | A | | 2/1986 | Watanabe et al. | |
| 4,651,682 | A | | 3/1987 | Pefley et al. | |
| 4,688,537 | A | | 8/1987 | Calkins et al. | |
| 4,826,517 | A | | 5/1989 | Norman | |
| 4,884,530 | A | | 12/1989 | Boekhaus et al. | |
| 5,010,868 | A | | 4/1991 | Clements | |
| 5,042,238 | A | | 8/1991 | White, III et al. | |
| 5,069,190 | A | | 12/1991 | Richards | |
| 5,343,699 | A | | 9/1994 | McAlister | |
| 5,411,058 | A | | 5/1995 | Welsh et al. | |
| 5,476,082 | A | | 12/1995 | Carpenter et al. | |
| 5,542,398 | A | | 8/1996 | Marcon | |
| 5,581,986 | A | | 12/1996 | Calver | |
| 5,667,730 | A | * | 9/1997 | Barfield | 261/18.3 |
| 5,676,117 | A | | 10/1997 | Williams | |
| 5,678,527 | A | | 10/1997 | Suzuki et al. | |
| 5,775,309 | A | | 7/1998 | Burrahm | |
| 5,803,035 | A | | 9/1998 | Guntly | |
| 5,868,117 | A | | 2/1999 | Moote et al. | |
| 6,120,007 | A | | 9/2000 | Grant | |
| 6,135,426 | A | | 10/2000 | Wargolet et al. | |
| 7,144,000 | B2 | * | 12/2006 | Roth et al. | 261/39.3 |
| 2005/0161028 | A1 | * | 7/2005 | Wolters | 123/527 |
| 2008/0060626 | A1 | | 3/2008 | Bayer et al. | |

FOREIGN PATENT DOCUMENTS

| | | | | | |
|---|---|---|---|---|---|
| EP | 1808587 | | 10/2007 | | |
| GB | 1315867 | | 5/1973 | | |
| GB | 2012356 | | 7/1979 | | |
| JP | 56-88938 | A * | 7/1981 | | 261/18.3 |
| JP | 57-203851 | | 12/1982 | | |
| JP | 60-176820 | | 9/1985 | | |
| WO | 02073015 | | 9/2002 | | |

OTHER PUBLICATIONS

Beam Products Mfg. Co. LP-Gas Conversions Product Brochure, Mar. 1985, 2 pages.

Lady, Paul, "Don't Overlook the Small Engine Market," Gas Industries, The Magazine of LP-Gas Distribution, Nov. 1974, 4 pages.

Osenga, Mike, "Honda adds first dual-fuel engines," Diesel Progress North American Edition, May 2003, 2 pages.

WINCO Product Brochure, "Home Power Tri-Fuel Portable Generator," Oct. 2002, 2 pages.

EP Search Report dated Aug. 20, 2007 of EP Publication No. EP1808587A3.

GGP Group, Trieviso, Italy, 2008 Catalogue, Global Garden Products, GGP Engine Technology.

* cited by examiner

SYSTEM AND METHOD FOR CONVERTING AN ENGINE TO AN ALTERNATE FUEL

BACKGROUND

The invention relates to a system and method for converting an engine to an alternative fuel. More particularly, the present invention relates to a system and method for converting an engine from gasoline to ethanol-based fuels (e.g., E85).

Internal combustion engines are typically designed for the particular fuel they combust. Thus, an engine designed to combust gasoline will generally not operate efficiently using an alternative fuel. In some cases, the engine simply will not operate using an alternative fuel.

SUMMARY

The present invention provides an engine conversion kit for converting an engine that combusts gasoline to an engine that combusts a fuel other than gasoline, such as E85 which is 85 percent ethanol and 15 percent gasoline. The engine includes a carburetor having a vent passageway that defines a vent size, and an automatic choke system. The kit includes a second carburetor including a primer passageway and a second vent passageway having a second vent size that is smaller than the vent size. The second carburetor is adapted to attach to the engine and replace the carburetor. A primer bulb is configured to connect to the engine and is operable to force air into the primer passageway.

In another construction, the invention provides a method of converting an engine that combusts gasoline to an engine that combusts a fuel other than gasoline. The engine includes a first carburetor having a first vent passageway that defines a first vent size, and an automatic choke system. The method includes removing the first carburetor from the engine, and attaching a second carburetor to the engine in place of the first carburetor. The second carburetor provides a primer passageway and a second vent passageway having a second vent size that is smaller than the first vent size. The method also includes connecting a primer bulb to the engine, wherein the primer bulb is operable to direct air into the primer passageway.

In yet another construction, the invention provides a replacement carburetor for an engine configured to combust a first fuel. The engine includes an air cleaner, and a first carburetor having a fuel bowl, a first vent passageway having a first flow area, and a first primer passageway that extends between the air cleaner and the fuel bowl. The first primer passageway is blocked to inhibit flow along the first primer passageway. The replacement carburetor is configured to attach to the engine to allow the engine to combust a second fuel. The replacement carburetor includes a carburetor body having a first flange, a second flange, and a carburetor throat therebetween. A fuel bowl is coupled to the body and is configured to contain a volume of fuel. A second vent passageway is at least partially defined by the carburetor body and extends between the first flange and the fuel bowl. The second vent passageway defines a second flow area that is smaller than the first flow area. A second primer passageway is configured to provide an uninterrupted flow of air between the air cleaner and the fuel bowl.

In another construction, the invention provides an engine conversion kit for converting an engine that combusts gasoline to an engine that combusts a fuel other than gasoline. The engine includes a carburetor having a vent passageway that defines a first vent size, and an automatic choke system. The kit includes a flow restrictor configured for engagement with the carburetor. The flow restrictor includes an aperture that defines a second vent size that is smaller than the first vent size. The kit also includes a primer bulb that is configured to connect to the engine and is operable to force air into the primer passageway.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
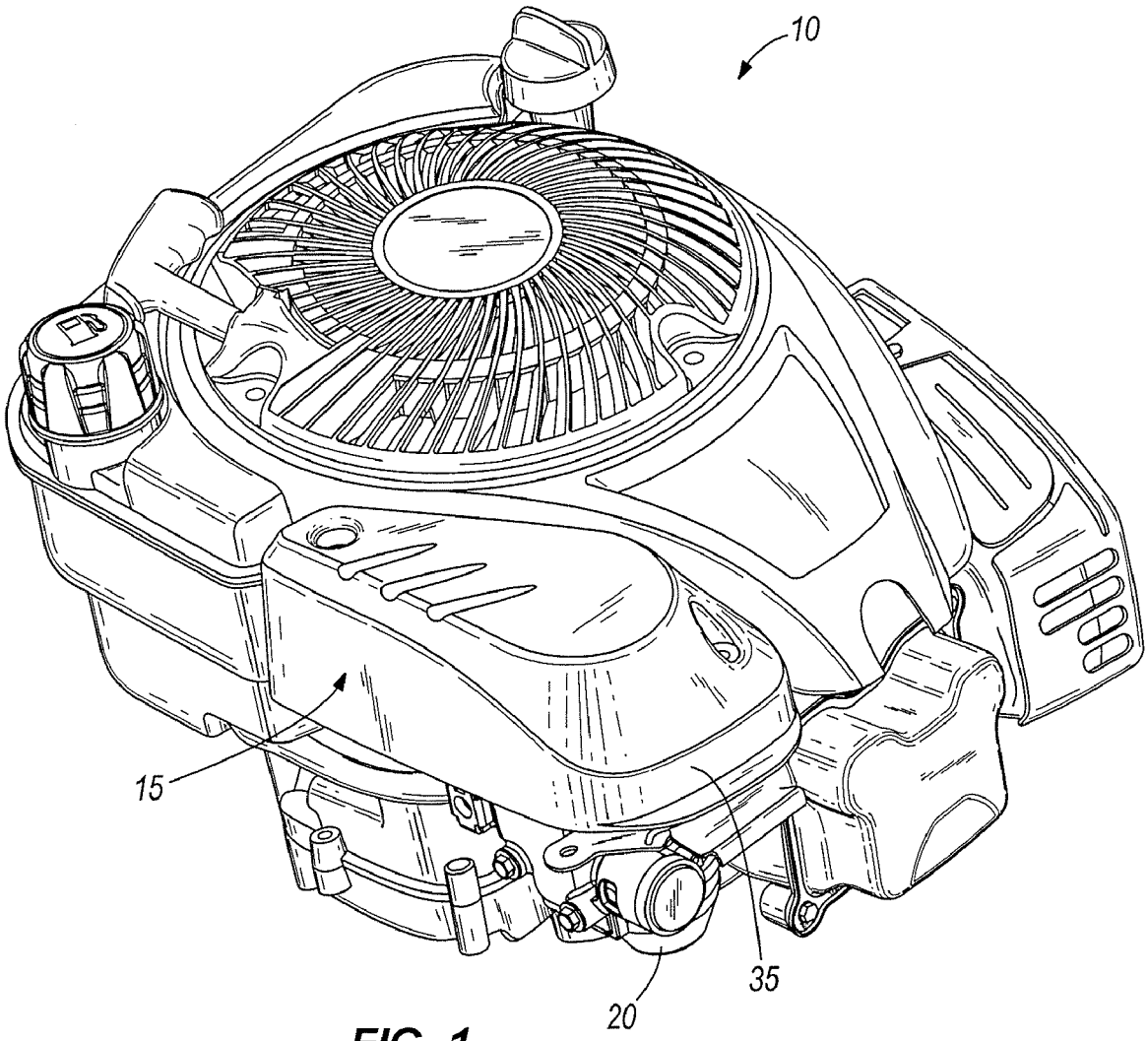
FIG. 1 is a perspective view of an engine configured to operate using gasoline or an alternative fuel.

FIG. 1 illustrates a small engine 10 that is well-suited for use in home and garden applications. For example, engines 10 of the type illustrated in FIG. 1 are commonly employed to power outdoor power equipment such as lawn mowers, snow blowers, generators, pressure washers, air compressors, pumps, and the like. Typically, small engines are one or two cylinder engines that produce less than about 45 hp.

The illustrated engine 10 includes a piston disposed within a cylinder. The cylinder cooperates with the piston to define a combustion chamber in which an air-fuel mixture is combusted to produce usable power. The engine 10 of FIG. 1 also includes an air cleaner 15 that filters air before the air is directed to the combustion chamber, and a fuel induction device such as a carburetor 20. The carburetor 20 operates to mix fuel with the filtered air at a desired ratio to produce an air-fuel mixture, and directs that air-fuel mixture to the combustion chamber for combustion. In the illustrated construction, a single piston and cylinder are employed. However, other constructions may employ two or more pistons that cooperate with two or more cylinders to define two or more combustion chambers. In addition, the invention described herein is well-suited for use in engine arrangements other than spark-ignited, piston driven internal combustion engines (e.g., rotary engines, compression-ignition engines, etc.).

Small engines 10 often include a choke system and a primer system that are used to aid in starting the engine 10. The choke system reduces air flow to the engine 10 such that the air-fuel mixture that is directed to the combustion chamber is richer than what could be achieved without the choke system. The primer system is used to force fuel into the carburetor 20 and the combustion chamber to aid in starting the engine 10 when there is little or no air flow. A user depresses a primer bulb one or more times to force air into the carburetor 20 which in turn forces fuel to move through the carburetor 20, as will be discussed in detail.

Some engines 10 employ an automatic choke system that automatically chokes the engine 10 based on the temperature of the engine 10. One such engine is sold by Briggs and Stratton Corporation has a READY START automatic choke system. U.S. Pat. No. 7,144,000 describes a system similar to the READY START system and is fully incorporated herein by reference and attached hereto. As illustrated in U.S. Pat. No. 7,144,000, an engine 10 with an automatic choke system can use the exhaust gas as an indicator of engine temperature to control the choke system of the engine 10. In engines 10 with an automatic choke, the priming system may be omitted. However, use of both an automatic choke and a priming system is particularly desirable for engines used in cold ambient conditions such as snow blower engines and for engines that use E85 or other lower energy content fuels.

Figure 2:
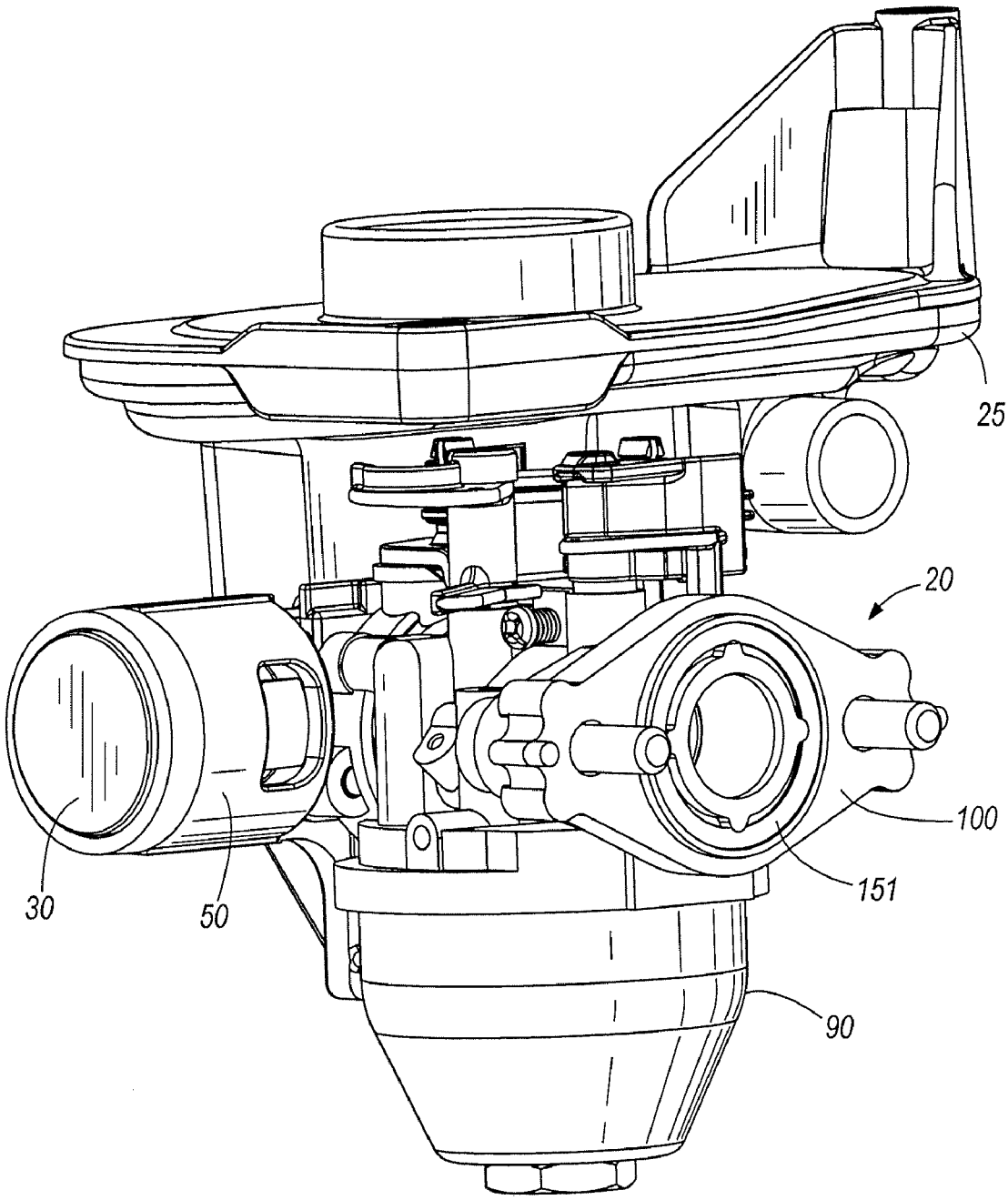
FIG. 2 is a perspective view of a portion of the engine of FIG. 1 including a carburetor and configured for use with gasoline.
Figure 3:
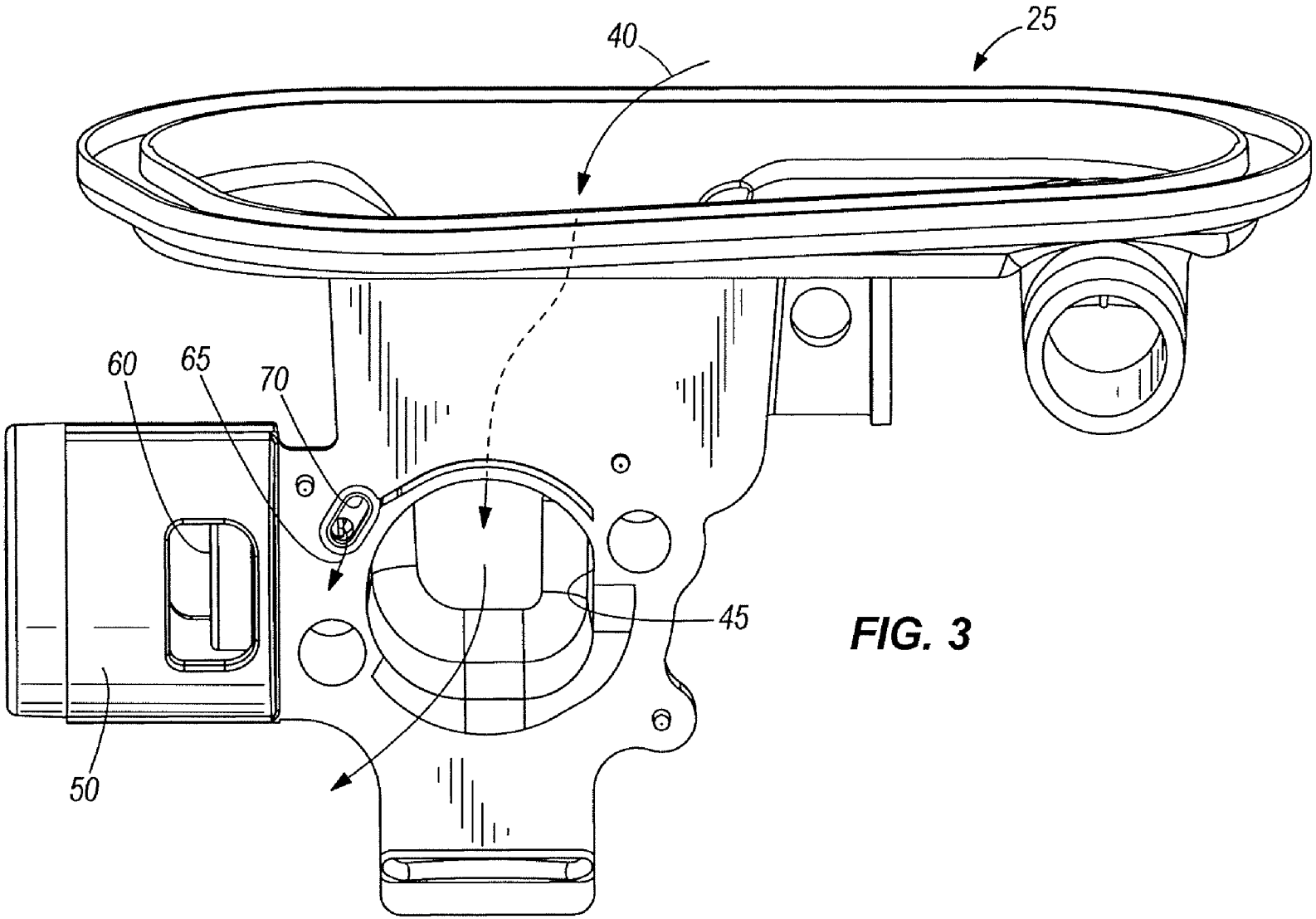
FIG. 3 is a perspective view of an air cleaner base of FIG. 2.
Figure 4:
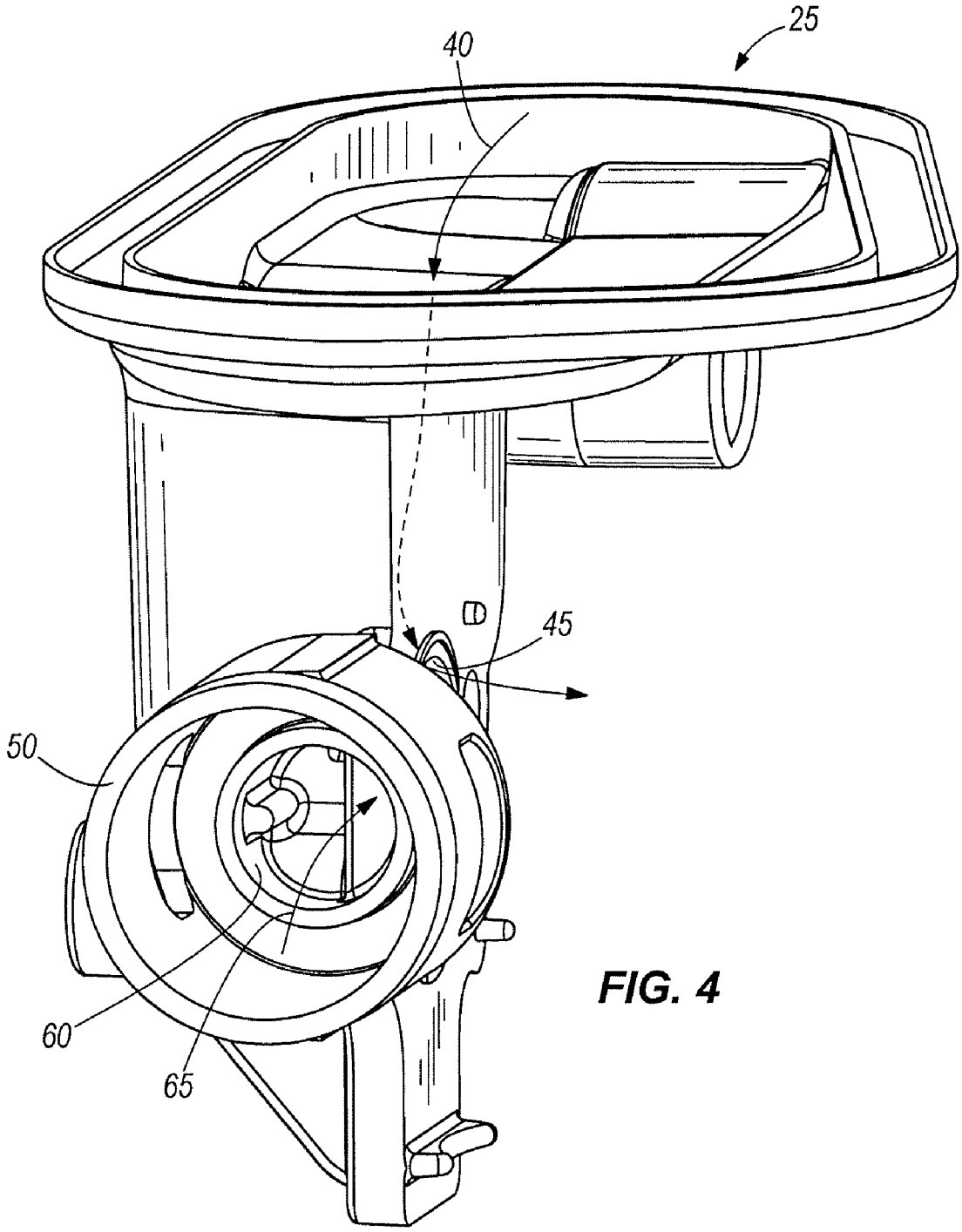
FIG. 4 is another perspective view of the air cleaner base of FIG. 2.

FIG. 2 illustrates a portion of the engine 10 of FIG. 1 that is arranged to operate with an automatic choke system, such that no priming system is necessary. The illustrated portion includes an air cleaner base 25, the carburetor 20, and a primer blank 30. The air cleaner base 25, illustrated in FIGS. 3 and 4, is typically formed from a plastic material or any other suitable material and is shaped to support an air filter (not shown) and a cover 35 (shown in FIG. 1). The air cleaner base 25 defines a flow passageway 40 through the base that terminates at an air outlet 45. The air outlet 45 is positioned adjacent the carburetor 20 such that the air cleaner base 25 directs a flow of filtered air to the carburetor 20 via the air outlet 45.

The air cleaner base 25 includes a primer bulb housing 50 that is arranged to selectively support a primer bulb 55 (shown in FIG. 7) or the primer blank 30 (shown in FIG. 2). The primer bulb housing 50 includes a primer aperture 60 (shown in FIG. 4) that opens to a primer passageway 65 formed as part of the air cleaner base 25. The primer passageway 65 leads to a primer outlet aperture 70 that is positioned adjacent the carburetor 20 and the air outlet 45. While the primer system may not be needed for the particular engine 10 illustrated, it is cost effective to manufacture one air cleaner base 25 that can be used in both engines that employ a priming system, and engines that do not employ a priming system.

As illustrated in FIG. 2, the primer blank 30 is used in the air cleaner base 25 for engines that do not need the priming system or engines onto which a primer system may later be retrofit. The primer blank 30 is a cylindrical component that fits within the primer bulb housing 50 of the air cleaner base 25 and covers the primer aperture 60 (FIG. 4). The primer blank 30 is substantially rigid so that it cannot be depressed by a user and as such is not operable to move air into the primer aperture 60.

Figure 5:
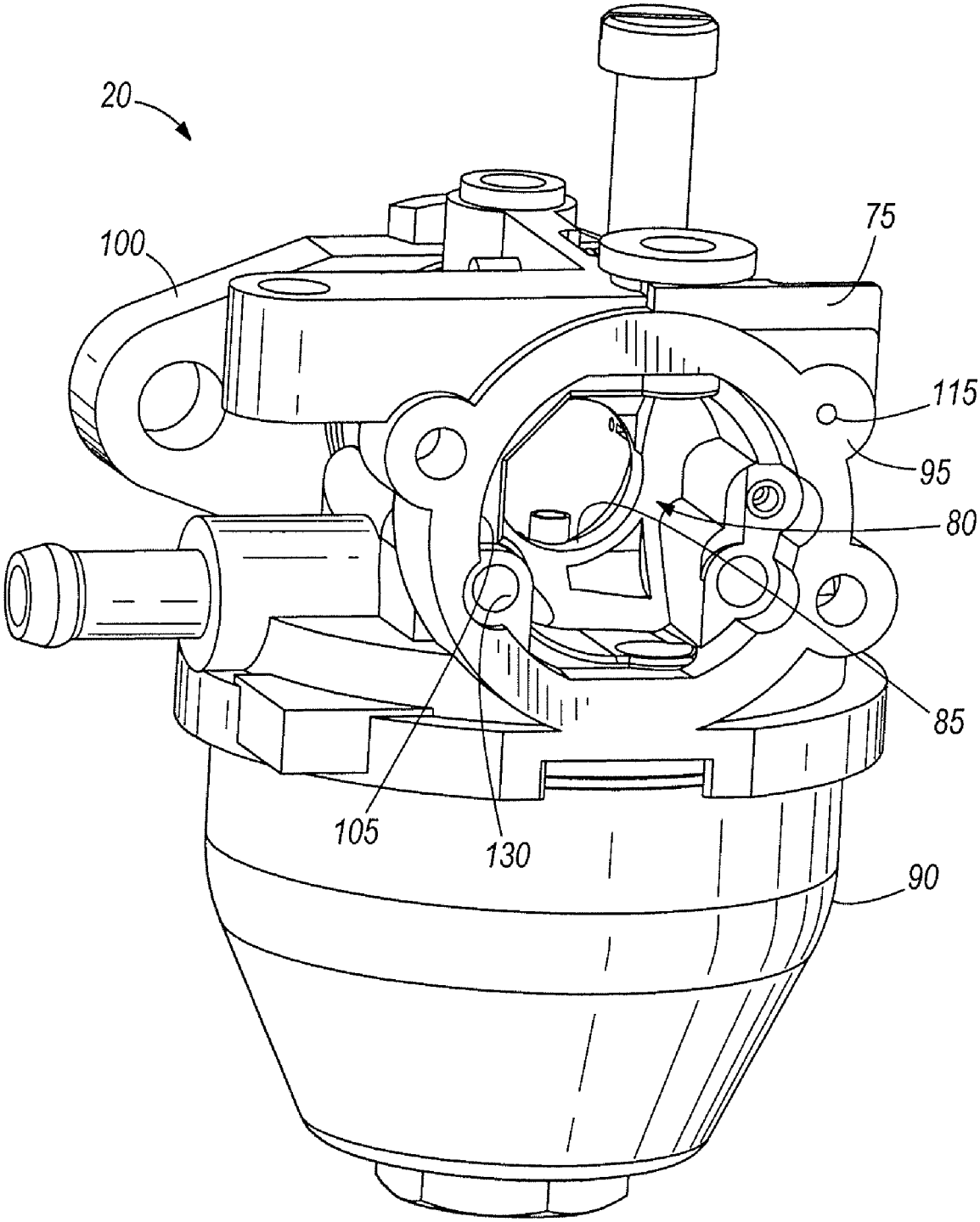
FIG. 5 is a perspective view of the carburetor of FIG. 2.

FIG. 5 illustrates the carburetor 20 of FIG. 2 in greater detail. The carburetor 20 includes a body 75 that defines a passage 80 having a throat portion 85, and a fuel bowl 90 as is commonly employed in a float-type carburetor. The body 75 includes a first flange 95 that facilitates attachment of the carburetor 20 to the air cleaner base 25, and a second flange 100 that connects to an intake runner and in turn to the engine cylinder or cylinders. The passage 80 includes an inlet opening 105 that is aligned with the air outlet 45 of the air cleaner base 25 such that filtered air from the air cleaner 15 flows into the carburetor 20, through the body 75, and to the intake runner. As the flow passes through the body 75, it is directed through the throat portion 85. The throat portion 85 causes an acceleration of the flow of air which produces a corresponding pressure drop. The pressure drop draws fuel from the fuel bowl 90 into the flow of air where the fuel mixes with the air to produce a combustible air-fuel mixture.

The carburetor 20 may include a priming passageway 110 (shown in FIG. 6) that includes an inlet 115 formed in the first flange 95. The inlet 115 is positioned to be aligned with the primer outlet aperture 70 of the air cleaner base 25 such that air discharged through the primer passageway 65 is directed into the priming passageway 110 of the carburetor 20. The carburetor priming passageway 110 extends from the inlet 115 to the fuel bowl 90 to allow air to flow from the primer bulb housing 50 into the fuel bowl 90.

In carburetor constructions that are intended for use with an engine 10 that employs an automatic choke system and does not employ a priming system, one or both of the inlet 115 and the priming passageway 110 may be omitted. However, as with the air cleaner base 25, the carburetor body 75 is typically formed with space to accommodate the inlet 115 and the priming passageway 110 to allow one carburetor body 75 to be used with either engine. As such, carburetors 20 for use in engines 10 that employ automatic choke systems may include the inlet 115 and priming passageway 110. However, the flow passageway between the primer bulb housing 50 and the fuel bowl 90 is blocked in one of several ways. In one arrangement, the inlet 115 is either plugged or covered by a gasket 120 (shown in FIGS. 10 and 11) to inhibit air flow through the priming passageway 110. Alternatively, the gasket 120 could include an opening 125, but one or more of the primer aperture 60, the primer outlet aperture 70, or the primer passageway 65 of the air cleaner base 25 is not formed or is otherwise blocked. In still other constructions, the priming passageway 110 between the primer inlet 115 and the fuel bowl 90 is completely defined and opened, but air flow is inhibited by the primer blank 30 which is positioned over the primer aperture 60. As one of ordinary skill in the art will realize, there are many ways to inhibit air flow between the primer bulb housing 50 and the fuel bowl 90. Any of these possible solutions could be employed if desired.

With reference to FIG. 5, the body 75 defines a vent passage 130 between the fuel bowl 90 and the passage 80. In carburetors 20 arranged for use with engines 10 that include an automatic choke system, the vent passage 130 is largely unobstructed such that the vent passageway 130 defines a first flow area. The vent passage 130 provides a flow passageway between the fuel bowl 90 and the passage 80 to assure that the pressure within the fuel bowl 90 does not increase greatly over the atmospheric pressure.

As one of ordinary skill in the art will appreciate, engines and carburetors are designed and "tuned" for operation with a particular fuel. While operation with a different fuel may be possible without such tuning, it is generally inefficient and can be detrimental to the life of the engine. The invention illustrated herein provides for the conversion of the engine 10 just described from operation combusting gasoline to operation combusting an alternative fuel, such as ethanol or other fuels containing ethanol (e.g., E85 which is 85 percent alcohol (ethanol) and 15 percent gasoline).

Figure 7:
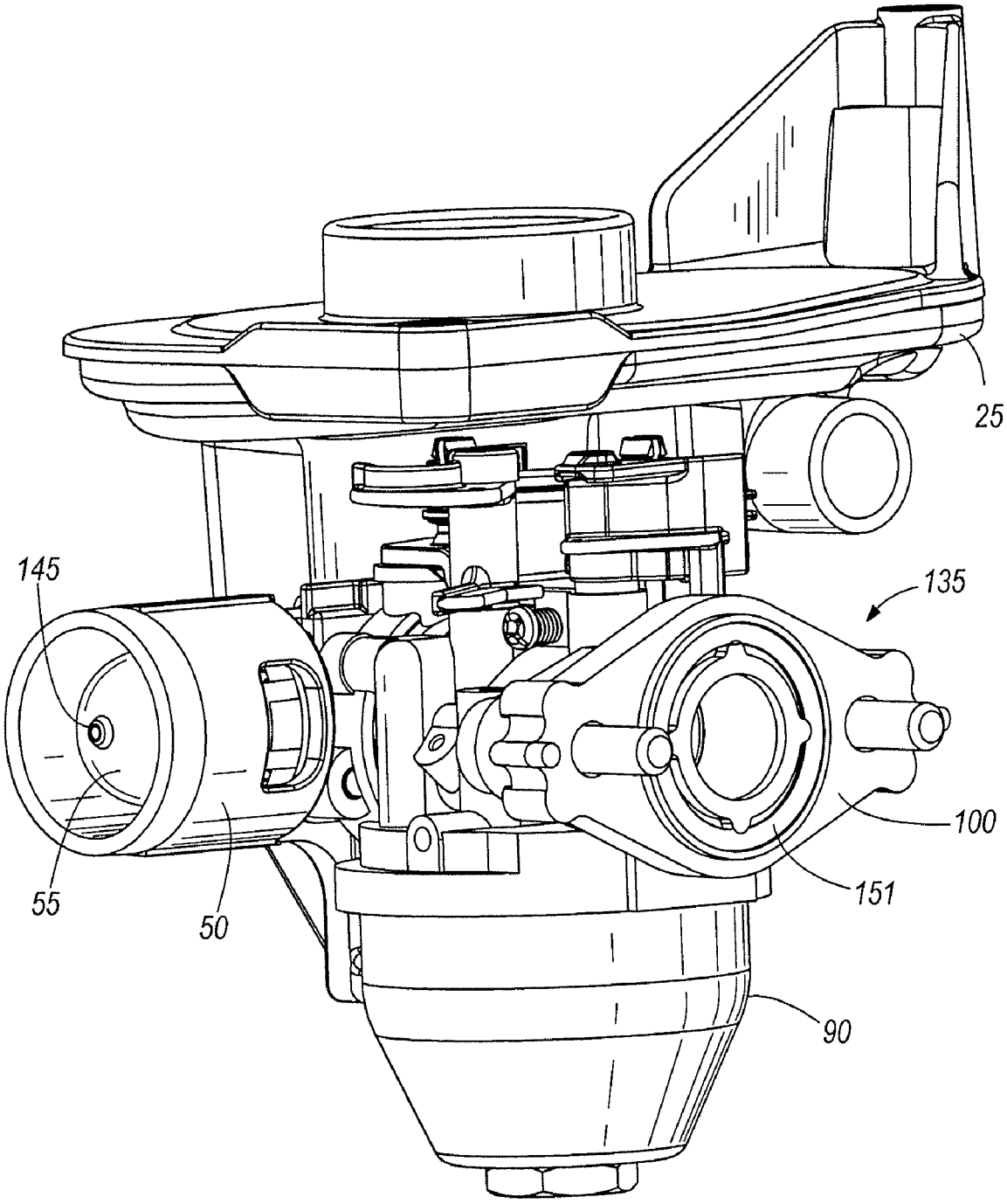
FIG. 7 is a perspective view of a portion of the engine of FIG. 1 including a carburetor and configured for use with an alternative fuel.
Figure 12:
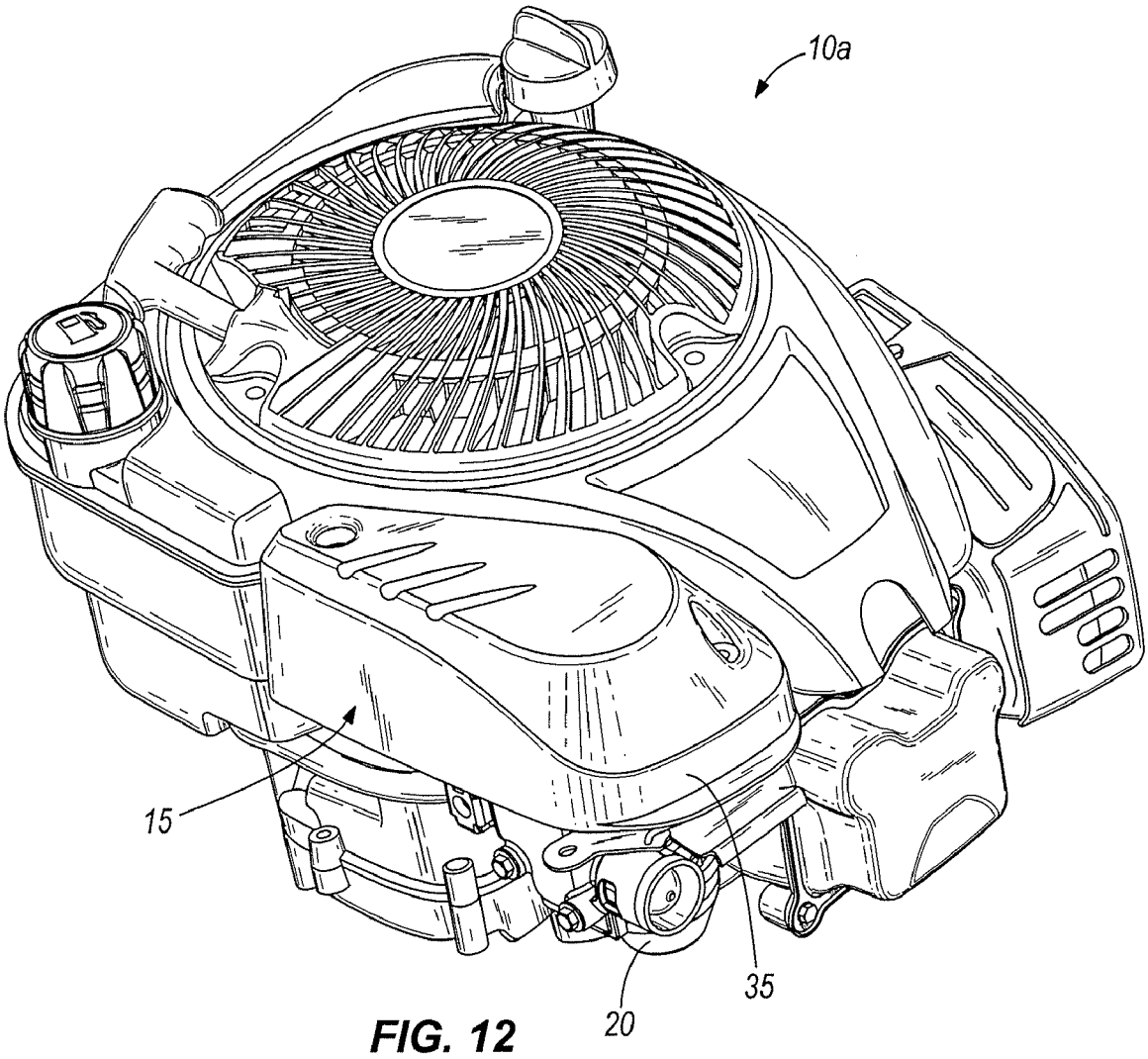
FIG. 12 is a perspective view of the engine of FIG. 1 configured to operate using an alternative fuel.

To convert the engine 10 of FIG. 1 from operation using the first fuel to operation using the alternative fuel, the portion of the engine of FIG. 1 illustrated in FIG. 2 is modified as illustrated in FIG. 7. An engine 10*a* (shown in FIG. 12) that includes the portion illustrated in FIG. 7 is configured to combust the alternative fuel rather than the original fuel.

Figure 13:
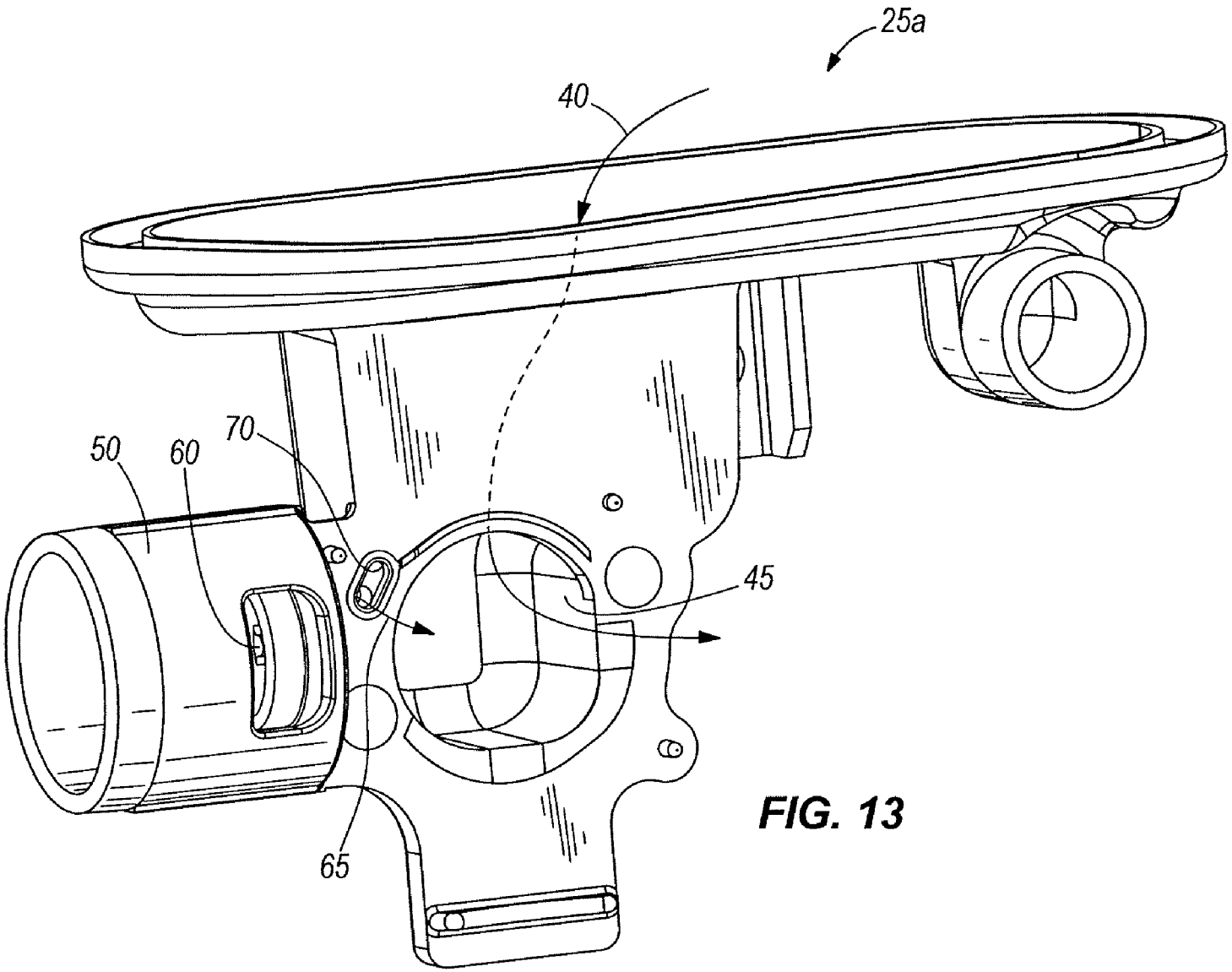
FIG. 13 is a perspective view of an air cleaner base configured for use with the alternative fuel.

With reference to FIG. 7, the converted engine 10*a* includes the air cleaner base 25, a second carburetor or a modified carburetor 135, and a primer bulb 140. In preferred arrangements, the air cleaner base 25 illustrated in FIGS. 3 and 4 fully defines the primer aperture 60, the primer outlet 70, and the primer passageway 65 therebetween. Thus, the air cleaner base 25 does not need to be replaced or modified. In constructions where the primer aperture 60, the primer outlet 70, and/or the primer passageway 65 therebetween are not fully defined, one would need to either modify the air cleaner base 25 or replace it with a base 25*a* shown in FIG. 13.

The primer blank 30 is removed from the primer bulb housing 50 and the primer bulb 55 is positioned in its place. Unlike the primer blank 30, the primer bulb 55 is flexible and is operable much like a bellows to push air into the primer aperture 60 when the bulb 55 is depressed by the user. Typically, the primer bulb 55 includes a one-way valve that allows air to enter the bulb 55 as it expands but forces the air into the primer flow passage 65 as the primer bulb 55 is depressed. In one construction, a valve is formed in the end of the primer bulb. The valve includes an aperture 145 in the primer bulb 55 that cooperates with a user's finger to function as a valve. As the user depresses the bulb 55, the user's finger covers the aperture 145 and inhibits the flow of air through the aperture 145. As such, the air is forced into the primer aperture 60. When the user releases the bulb 55, the aperture 145 is uncovered and air is drawn into the primer bulb 55. Of course other arrangements and constructions of the primer bulb 55 and valve are possible.

Figure 6:
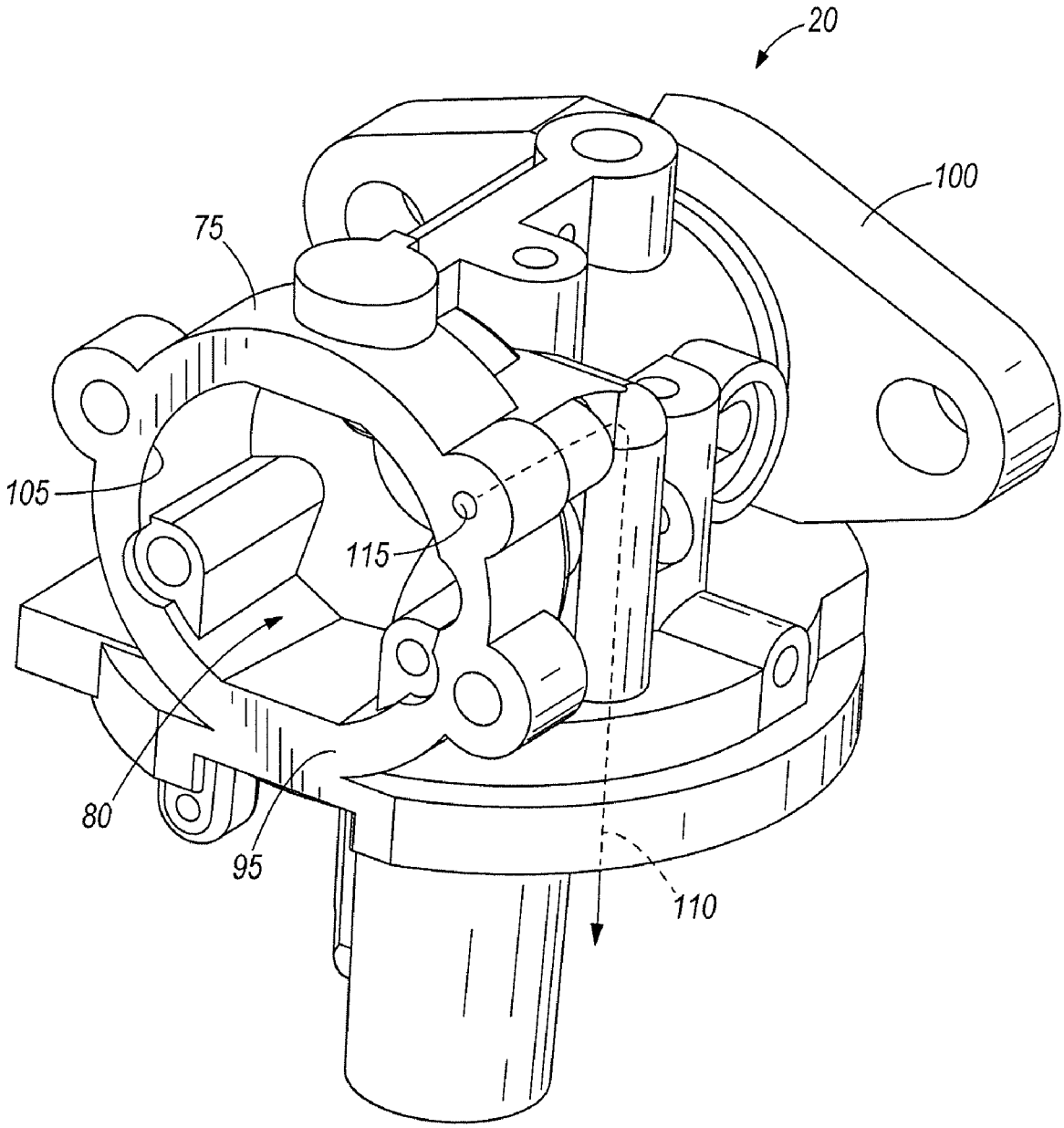
FIG. 6 is another perspective view of the carburetor of FIG. 2.
Figure 8:
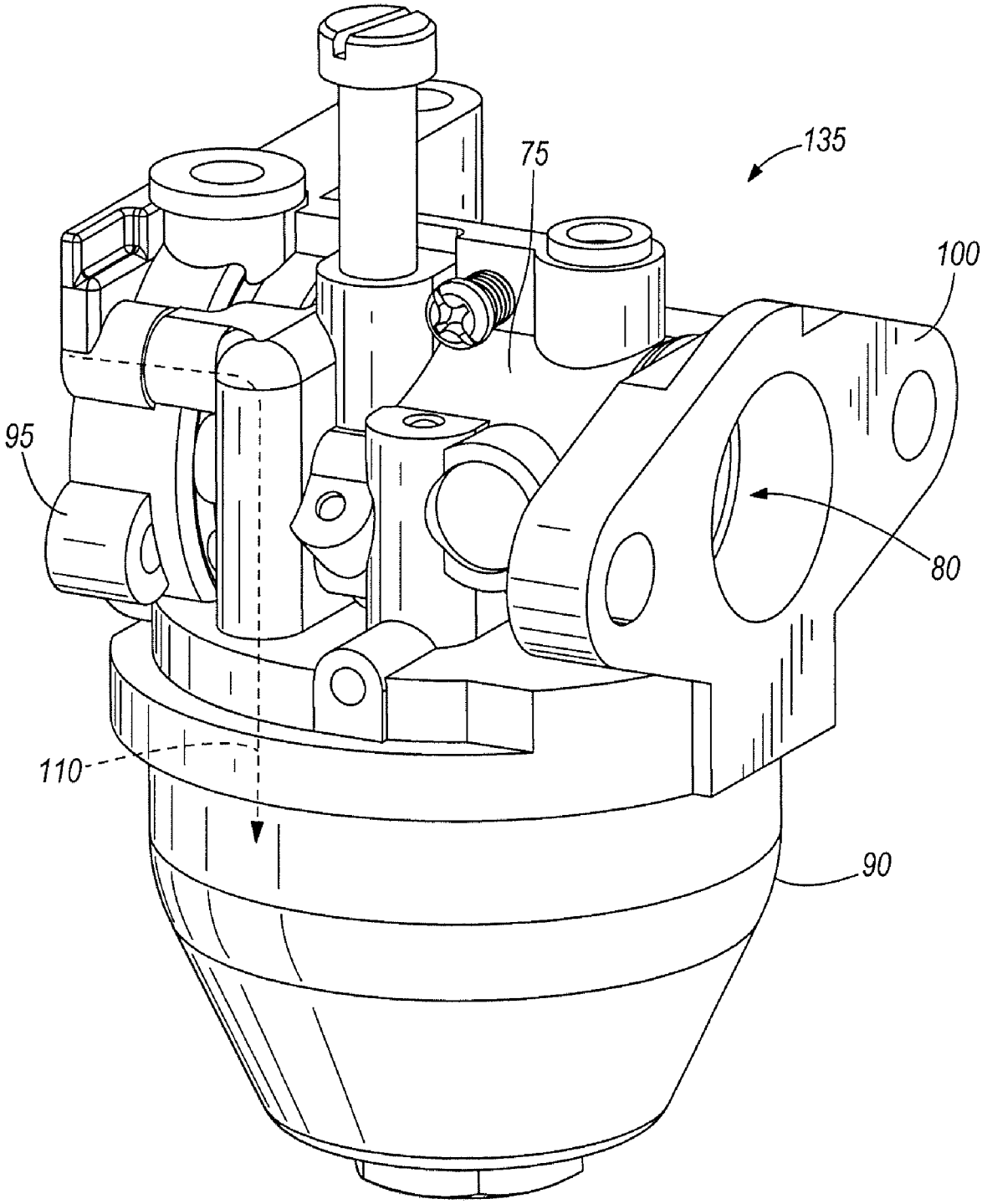
FIG. 8 is a perspective view of the carburetor of FIG. 7.
Figure 9:
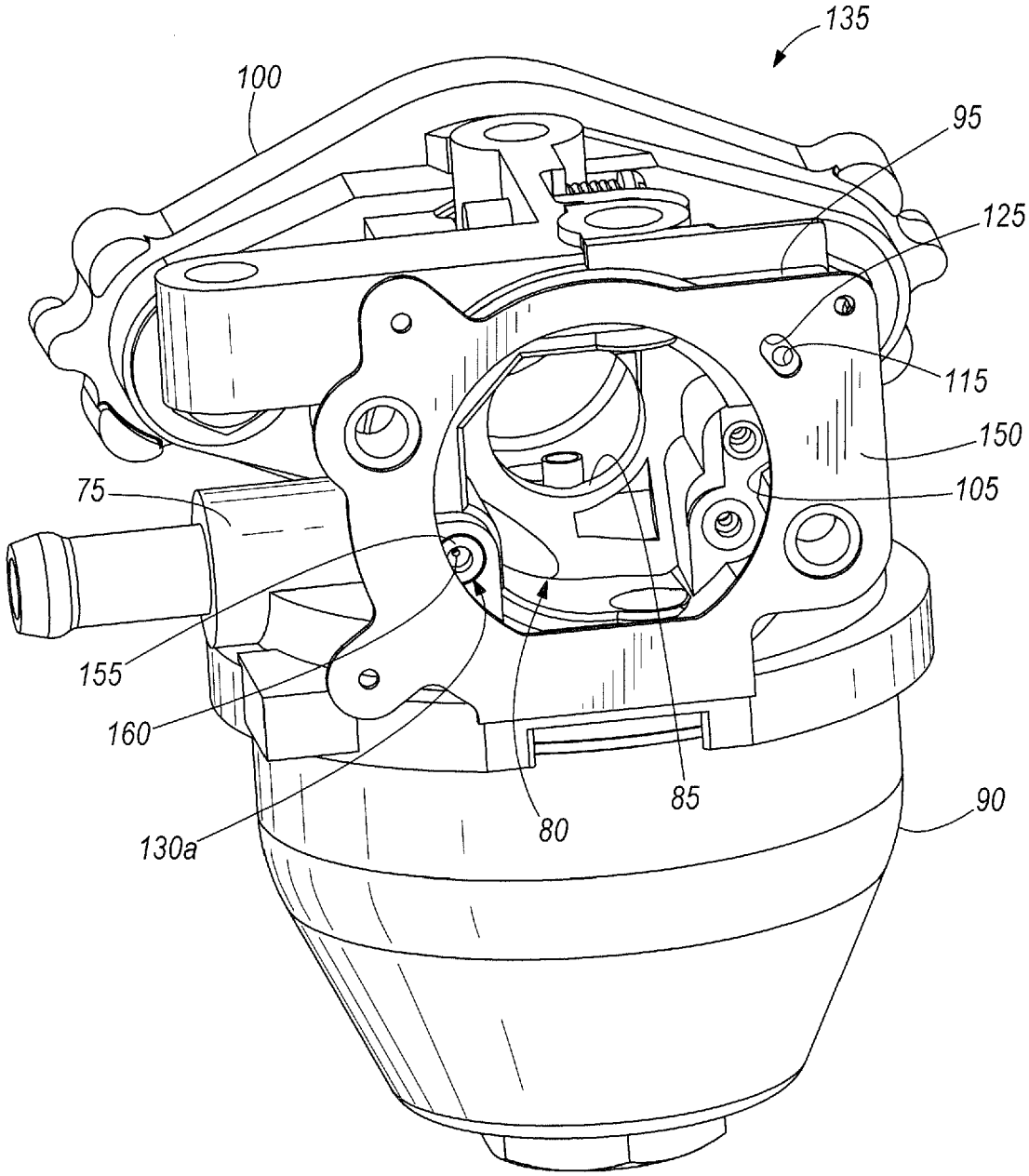
FIG. 9 is an enlarged perspective view of a portion of the carburetor of FIG. 8.

The carburetor 20 illustrated in FIGS. 5 and 6 is replaced by, or modified to resemble the second carburetor 135 illustrated in FIGS. 8 and 9. The second carburetor 135 includes the primer inlet 115 as well as the complete priming passageway 110 that leads to the fuel bowl 90. While the original carburetor 20 could be employed so long as it includes a complete flow passageway between the inlet 115 and the fuel bowl 90, it is possible that the first carburetor 20 is made from a material that is not optimized for use with the alternative fuel. For example, to be compatible with ethanol-based fuels, the second carburetor 135 can be manufactured from stainless steel rather than aluminum, can be manufactured from anodized aluminum, or can be manufactured from aluminum that is coated or plated with nickel. Of course, other coatings, processes, or materials, including aluminum, could be employed to form the carburetor 135 if desired.

The gasket 120 (shown in FIG. 10) positioned between the second carburetor 135 and the air cleaner base 25 is preferably replaced with a gasket 150 (shown in FIG. 11) that includes the opening 125 between the primer outlet 70 of the air cleaner base 25 and the inlet 115 of the second carburetor 135. The replacement gasket 150 is preferably formed from a material that is suitable for use with the alternative fuel such as for example neoprene, VITON brand elastomer from DuPont, or other materials, which are well-suited for use with ethanol-based fuels. It should be noted that a second gasket (not shown) is typically positioned between the carburetor 20 and the intake runner. Typically, the second gasket is formed from a material similar to that used for the gasket 120. In constructions in which this material is not compatible with the alternative fuel, the second gasket is typically replaced with another second gasket formed from an alternative material.

In still other constructions, a spacer (not shown) is positioned between the carburetor 20 and the intake runner. The spacer allows the carburetor 20 and intake runner to be spaced apart differently in different engine designs. In these constructions, the second gasket is positioned between the carburetor 20 and the spacer, and a third gasket or o-ring 151 is positioned between the spacer and the intake runner. In these constructions, if the gasket or o-ring material is not compatible with the alternative fuel, both gaskets and o-rings 151 would typically be replaced with other gaskets or o-rings 151 that are formed from materials that are suited for use with the alternative fuel.

Figure 10:
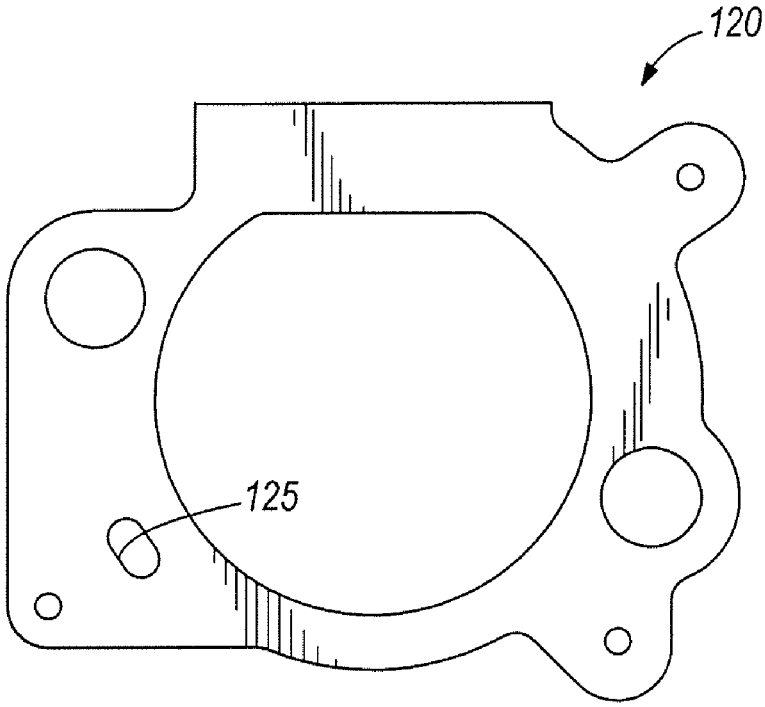
FIG. 10 is a front view of a gasket in a first position.
Figure 11:
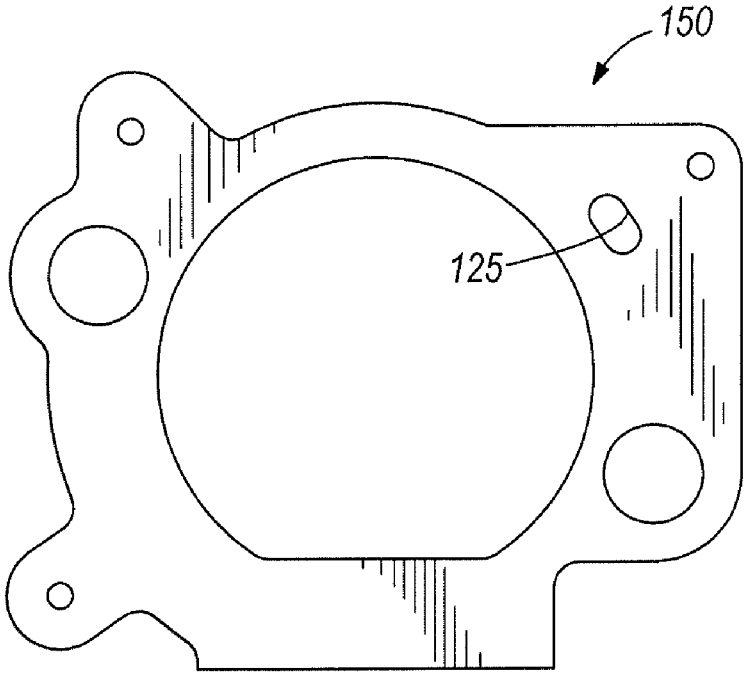
FIG. 11 is a front view of the gasket of FIG. 10 in an inverted position.

Other constructions may employ the original alcohol-resistant gasket 120 and either modify the gasket to include the necessary opening 125 or invert an asymmetric gasket 120 to align the necessary aperture 125. In constructions that employ the asymmetric gasket 120, the gasket 120 is formed to include the opening 125 that is configured to be selectively aligned with the primer inlet 115. When the gasket 120 is used in the first engine 10, the gasket is positioned as illustrated in FIG. 10. In this position, the aperture 125 is not aligned with the primer inlet 115, thereby allowing the gasket 120 to block air flow between the primer bulb housing 50 and the fuel bowl 90. To align the opening 125, the user simply inverts the gasket 120 such that the gasket 150 is arranged as illustrated in FIG. 11. When the gasket 120 is in its original (non-inverted) position (FIG. 10), the opening 120 is not aligned with any openings and performs no function. Once the gasket 120 is positioned to resemble the gasket 150 illustrated in FIG. 11, the aperture 125 is aligned with the primer inlet 115 to allow for the flow of air through the aperture 125 in the gasket 150. However, it should be noted that the gasket material may not be compatible with the alternative fuel. If this is the case, it is often desirable to simply replace the gasket 120 with a gasket 150 made using a more compatible material.

The vent passageway 130*a* of the second carburetor 135 is modified as compared to the vent passageway 130 of the first carburetor 20 to allow for the pressurization of the fuel bowl 90 above atmospheric pressure. To achieve this, the vent passageway 130*a* of the second carburetor 135 includes a flow restrictor 155 that includes an aperture 160 that is sized to restrict the flow of air out of the fuel bowl 90. Thus, the aperture 160 of the flow restrictor 155 defines a second flow area that is smaller than the first flow area defined by the first vent passageway 130.

Use of the primer bulb 55 forces air into the fuel bowl 90 which forces fuel into the carburetor throat 85 and forces some air out of the vent passageway 130*a*. The size of the aperture 160 controls the pressure within the fuel bowl 90 by allowing air to escape from the fuel bowl 90 at a rate that is related to the pressure within the fuel bowl 90. If the vent passageway 130*a* of the second carburetor 135 were not modified as described, the primer bulb 55 would not be able to sufficiently pressurize the fuel bowl 90 and fuel would not be delivered to the carburetor throat 85 as the air would simply escape through the larger flow passageway.

Figure 14:
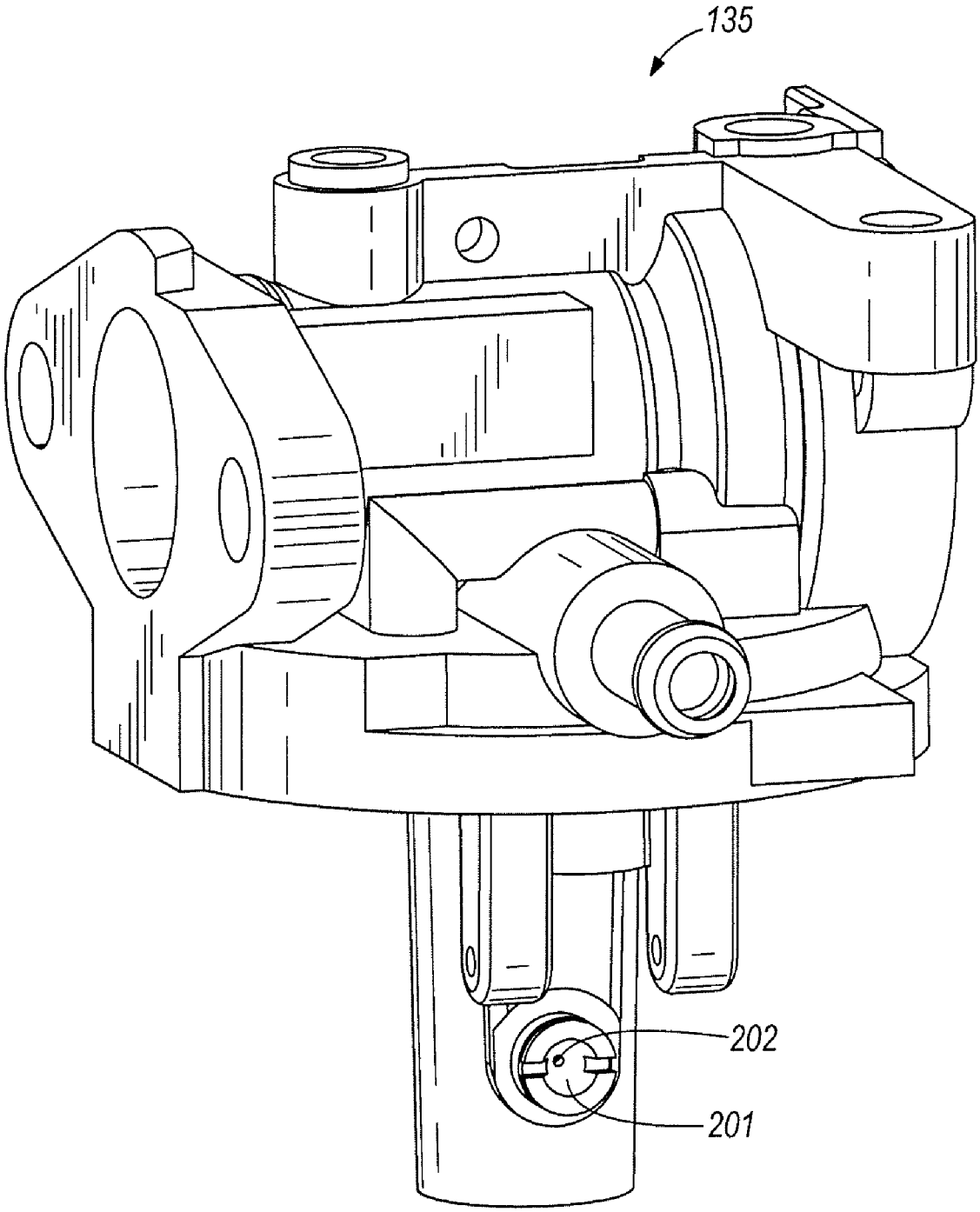
FIG. 14 is a perspective view of the carburetor of FIG. 7 including a replacement main fuel jet.
Figure 15:
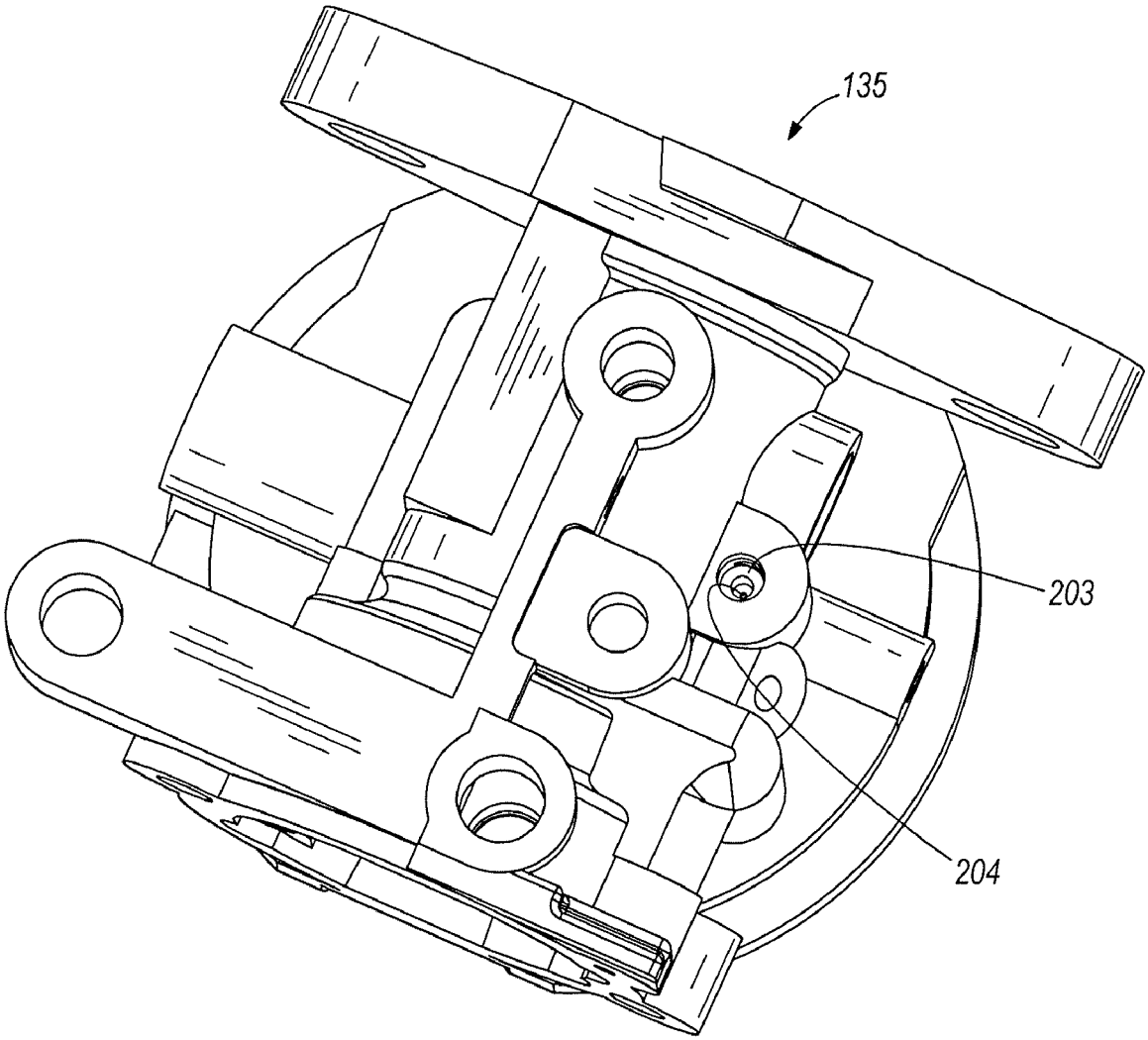
FIG. 15 is a perspective view of the carburetor of FIG. 7 including a replacement slow fuel jet.
Figure 16:
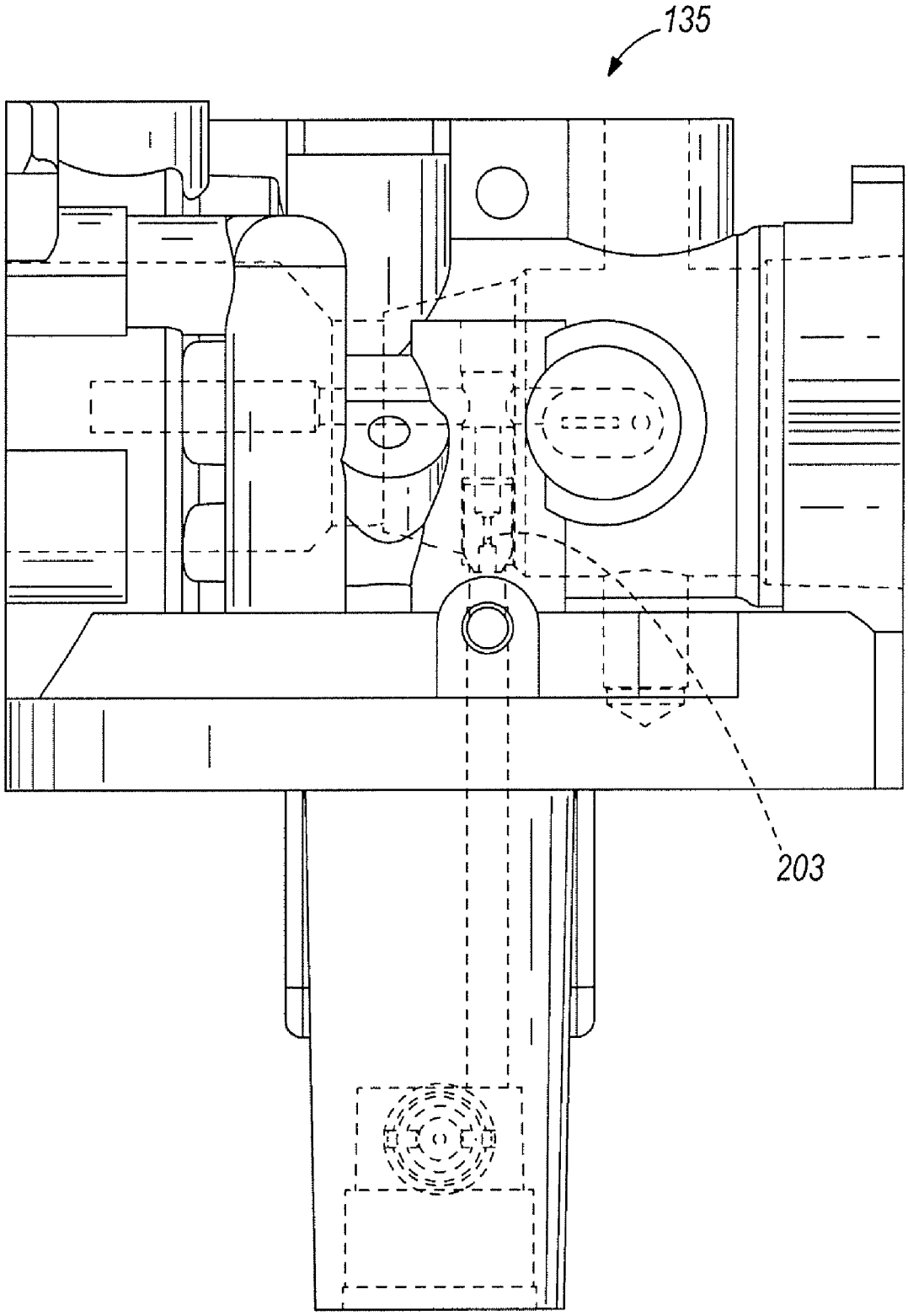
FIG. 16 is a side view of the carburetor of FIG. 7 including the replacement slow fuel jet.

E85 fuel has a lower energy value than the gasoline that normally powers the engine. As such, more E85 fuel must be delivered to the engine. To accomplish this, the fuel jets within the carburetor are enlarged or replaced to provide the additional flow area. With reference to FIG. 14, a main fuel jet 201 includes an aperture 202 that is sized to pass a predetermined quantity of fuel. The aperture 202 is about 40 percent larger than the aperture 202 for use with gasoline. Of course, other fuel types would require a different size aperture depending on the energy content of the fuel. A slow jet 203, shown in FIGS. 15 and 16, includes a second aperture 204 that is also enlarged (or the jet 203 is replaced) to provide a similar change in flow area as is provided for the main fuel jet 201. Thus, for a conversion from gasoline to E85, an increase of about 40 percent is employed for both the main jet 201 and the slow jet 203.

To use the engine 10*a* with the alternative fuel, the user first primes the engine 10*a*. To prime the engine 10*a*, the user depresses the primer bulb 55 to force air into the fuel bowl 90 to pressurize the fuel bowl 90. The higher pressure within the fuel bowl 90 forces fuel into the carburetor throat 85 to aid in starting the engine 10*a*. Once the engine 10*a* is started, the air flow through the carburetor throat 85 is sufficient to draw fuel for combustion and the engine 10*a* operates in much the same way as the engine 10.

To facilitate the conversion of an engine 10 that combusts gasoline and includes an automatic choke system, to one that combusts the alternative fuel, one can provide a kit with the desired replacement parts. At a minimum, the kit should include the flow restrictor 155 for the vent passageway 130*a* and the primer bulb 55. The existing carburetor 20 can be modified to accept the flow restrictor 155. For example, the existing vent passageway 130 could be threaded to receive a threaded flow restrictor 155. The primer blank 30 is replaced with the primer bulb 55 to allow the user to use the priming system. To complete the flow passageway between the primer bulb 55 and the fuel bowl 90, the gasket 120 is either replaced, modified, or inverted as illustrated in FIG. 11 to provide an opening 125 through the gasket 150.

In a more preferred kit, the second carburetor 135, a gasket 150, and the primer bulb 55 are included. With this kit, the primer blank 30 is replaced with the primer bulb 55 and the carburetor 20 is replaced with the second carburetor 135. The new gasket 150 is used to reduce the likelihood of leakage and to assure that there are no material incompatibilities. Of course, kits could be provided with only the second carburetor 135 and the primer bulb 55 in arrangements where the gasket 120 is reused.

Thus, the invention provides, among other things, a new and useful system and method for converting a gasoline engine 10 for use with ethanol-based fuels, such as E85. The invention includes a kit that provides the necessary replacement components to convert a gasoline engine 10 to ethanol-based fuels, such as E85.

What is claimed is:

1. A replacement carburetor for an engine configured to combust a first fuel, the engine including an air cleaner, and a first carburetor having a fuel bowl, a first vent passageway having a first flow area, and a first primer passageway that extends between the air cleaner and the fuel bowl, the first vent passageway being blocked to inhibit flow along the first vent passageway, the replacement carburetor configured to be attached to the engine to allow the engine to combust a second fuel, the replacement carburetor comprising:

a carburetor body including a first flange, a second flange, and a carburetor throat therebetween;

a fuel bowl coupled to the body and configured to contain a volume of fuel;

a second vent passageway at least partially defined by the carburetor body and extending between the first flange and the fuel bowl, the second vent passageway defining a second flow area that is smaller than the first flow area; and a second primer passageway configured to provide an uninterrupted flow of air between the air cleaner and the fuel bowl.

2. The replacement carburetor of claim 1, further comprising a main jet coupled to the carburetor body and having a main jet aperture that has a flow area that is about 40 percent larger than a main jet flow area of the first carburetor.

3. The replacement carburetor of claim 2, further comprising a slow jet coupled to the carburetor body and having a slow jet aperture that has a flow area that is about 40 percent larger than a slow jet flow area of the first carburetor.

4. The replacement carburetor of claim 1, further comprising: a gasket adjacent the first vent passageway configured to inhibit flow along the first vent passageway.

5. The replacement carburetor of claim 1, further comprising: a plug in the first vent passageway configured to inhibit flow along the first vent passageway.

6. The replacement carburetor of claim 1, wherein the carburetor is at least one made from, coated with and plated with a material that is compatible with ethanol-based fuels.

* * * * *